US005210934A

United States Patent [19]

Lenzi et al.

[11] Patent Number: 5,210,934

[45] Date of Patent: May 18, 1993

[54] EXTRACTION TOOL FOR HIGH DENSITY CABLE CONNECTORS

[75] Inventors: George Lenzi, Wheaton; John B. Portzer, Elmhurst, both of Ill.

[73] Assignee: AG Communication Systems Corporation, Phoenix, Ariz.

[21] Appl. No.: 797,658

[22] Filed: Nov. 25, 1991

[51] Int. Cl.[5] ..... H01R 43/00

[52] U.S. Cl. ..... 29/764; 29/747

[58] Field of Search ..... 29/764, 747, 748, 758, 29/426.6

[56] References Cited

U.S. PATENT DOCUMENTS 4,425,704 1/1984 Cline ..... 29/764

5,119,547 6/1992 Hidehiro, II ..... 29/764

*Primary Examiner*—Carl E. Hall

*Attorney, Agent, or Firm*—Anthony J. Baca

[57] ABSTRACT

A tool for extracting a cable connector from a cable shroud. The cable and cable connector are connected to a cable shroud. The extraction tool must disengage the shroud locking tabs before the cable connector can be removed. The alignment members mate with the cable connector and, when fully inserted, disengage the shroud locking tabs. To remove the cable connector, the extraction tool must be firmly attached to the cable connector. This is accomplished by forcing the engagement pins into the engagement holes. The engagement pins are forced into the engagement holes by moving the actuator plate from the open position to the closed position causing the locking apparatus to force the engagement pins into the engagement holes.

11 Claims, 8 Drawing Sheets

102
101
OPEN
103

RIGHT GUIDE

LEFT GUIDE

EXTRACTION TOOL FOR HIGH DENSITY CABLE CONNECTORS

FIELD OF THE INVENTION

The present invention relates to cable connectors and more specifically, to a tool designed to extract cable connectors from their mating shrouds.

BACKGROUND OF THE INVENTION

Prior to the present invention, high density connectors such as the one designed by GTE Sylvania (HDI type) were difficult to remove. Generally, screwdrivers and various hand tools were used to pry open the latching tabs on the shroud causing damage to the cable connectors, shroud, and even sometimes the cable itself.

Therefore, it is the objective of the present invention to provide a manually operated hand tool for the quick and easy extraction of the cable connector. Additionally, this same tool should aid in the insertion of the cable connector.

SUMMARY OF THE INVENTION

In order to accomplish the object of the present invention there is provided a tool for extracting a cable connector from a cable shroud. The cable connector has engagement holes and locking tabs. The tool is made from the following major components.

A handle that has a first side and a second side. A first set of guides with one end firmly attached to the first side of the handle. A second set of guides with one end firmly attached to the second side of the handle so that, when the tool is properly placed over the cable connector, the first set of guides and the second set of guides unlock the locking tabs of the cable shroud. The second set of guides also have a set of holes extending laterally through the second set of guides such that when the tool is properly mated to the cable connector, the set of holes align with the engagement holes.

Next, a locking plate with one end firmly attached to the second side of the handle. The end of the second set of guides and the end of the locking plate are commonly attached to the side of the handle. The locking plate extends over the second set of guides and has a set of engagement pins aligned to mate with the set of holes in the second set of guides.

Finally, an actuator plate is attached to the second side of the handle in a manor that allows the actuator plate to move longitudinally along the second side of the handle. Whereby moving the actuator plate longitudinally along the second side of the handle moves the locking plate laterally forcing the engagement pins through the set of holes in the second set of guides and into the engagement holes in the cable connector; thereby providing a mechanical connection between the tool and the cable connector. The mechanical connection allows proper extraction of the cable connector from the cable shroud.

DESCRIPTION OF THE DRAWINGS

A better understanding of the invention may be had from the consideration of the following detailed description taken in conjunction with the accompanying drawings, in which.

DESCRIPTION OF THE PREFERRED EMBODIMENT

Figure 1:
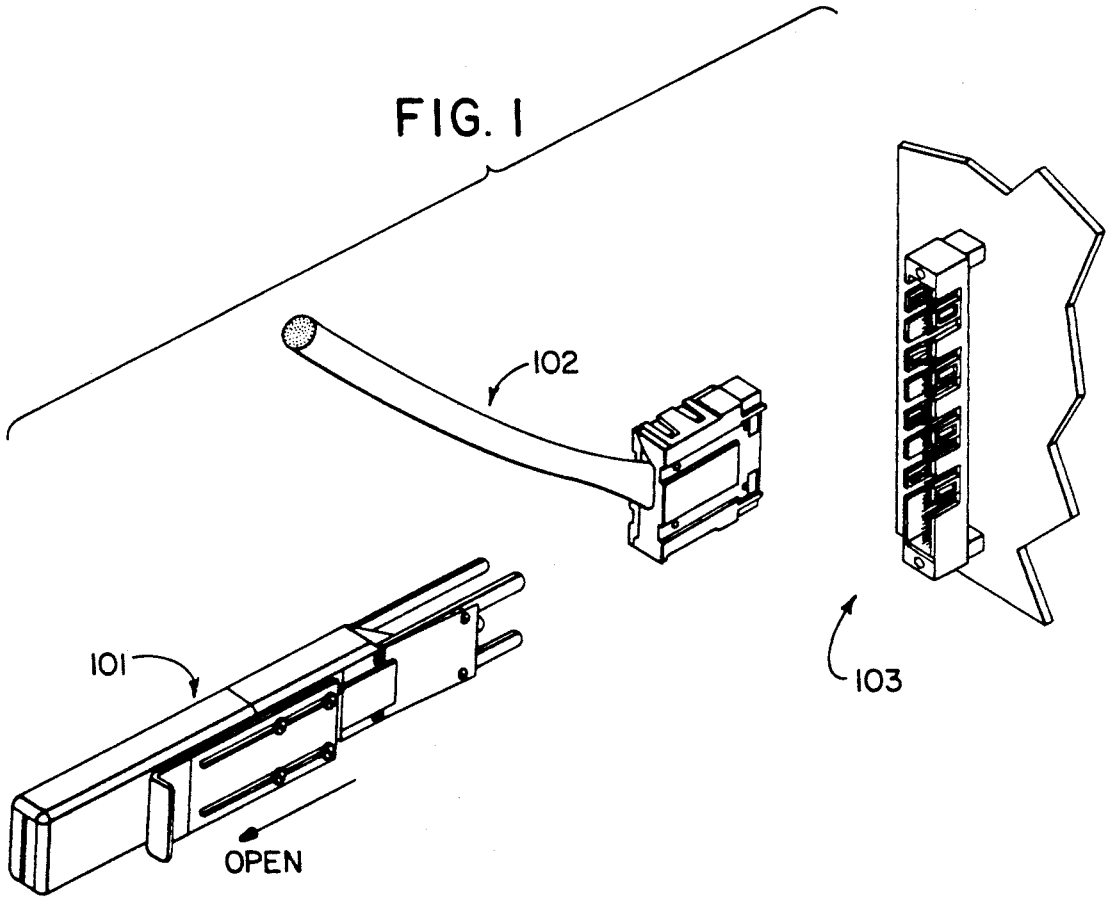
FIG. 1 is a pictorial representation of the present invention along with the cable connector to be extracted or inserted.

Referring to FIG. 1, the claimed invention 101 along with the cable just extracted 102 and the receiving socket 103 are shown.

Figure 2:
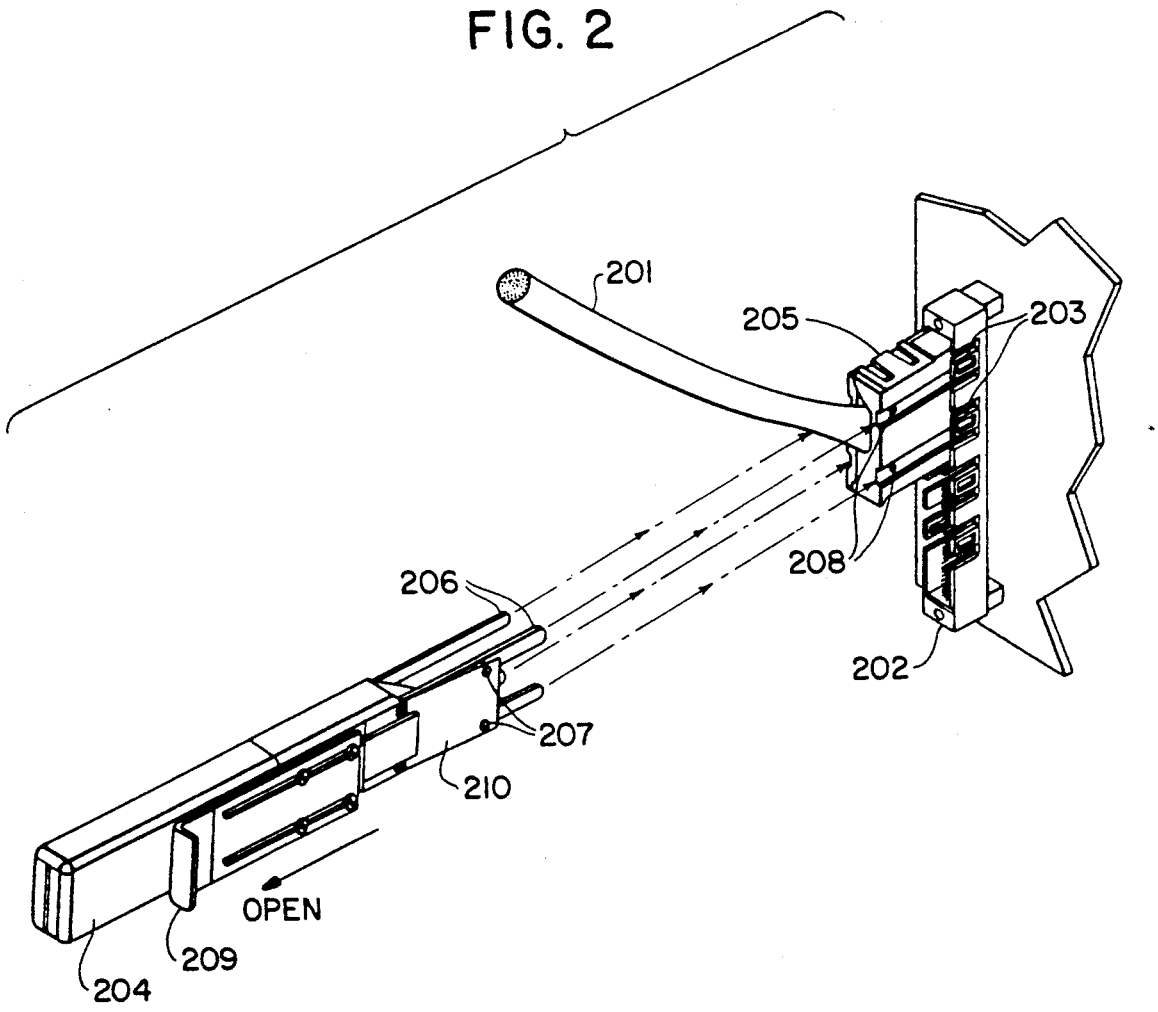
FIG. 2 shows the present invention being aligned in preparation to extract the cable connector.
Figure 3:
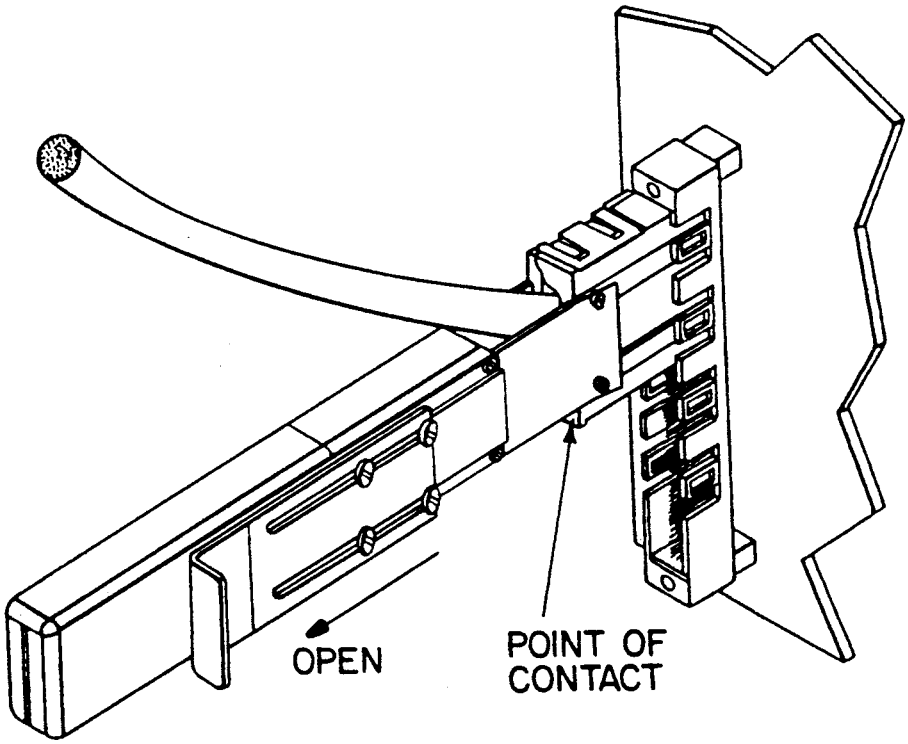
FIG. 3 shows the present invention mating to the cable connector.

Referring next to FIG. 2 where the present invention is shown in greater detail. Here, CABLE 201 and CABLE CONNECTOR 205 are connected to CABLE SHROUD 202 and ready for extraction. The EXTRACTION TOOL 204 must disengage SHROUD LOCKING TABS 203 before CABLE CONNECTOR 205 can be removed. ALIGNMENT MEMBERS 206 mate with CABLE CONNECTOR 205 and, when fully inserted, disengage SHROUD LOCKING TABS 203, as shown in FIG. 3.

Figure 4:
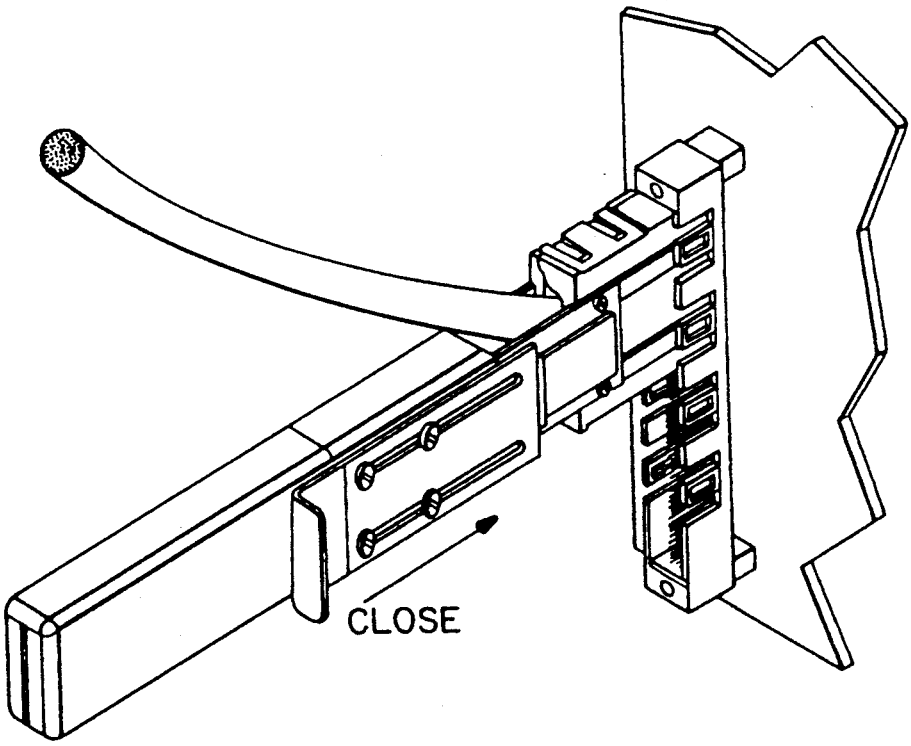
FIG. 4 the present invention mating to the cable connector as in FIG. 3, with engagement pins in proper position.

To remove CABLE CONNECTOR 205, EXTRACTION TOOL 204 must be firmly attached to CABLE CONNECTOR 205. This is accomplished by forcing ENGAGEMENT PINS 207 into ENGAGEMENT HOLES 208. ENGAGEMENT PINS 207 are forced into ENGAGEMENT HOLES 208 by moving ACTUATOR PLATE 209 from the open position to the closed position causing LOCKING APPARATUS 210 to force ENGAGEMENT PINS 207 into ENGAGEMENT HOLES 208. This can be seen in FIG. 4

Figure 5:
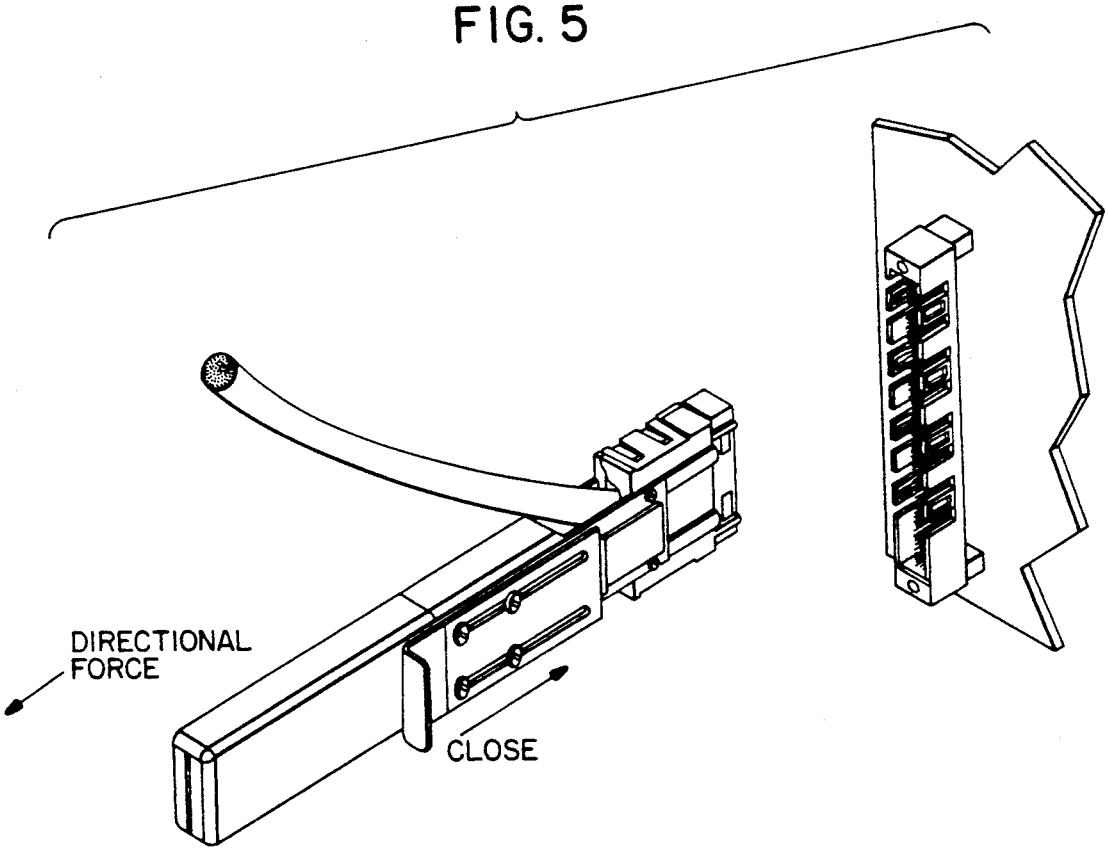
FIG. 5 shows the present invention and cable connector being extracted.

Once ENGAGEMENT PINS 207 are forced into ENGAGEMENT HOLES 208, CABLE CONNECTOR 205 can be extracted from CABLE SHROUD 202 with a longitudinal force as shown in FIG. 5. After CABLE CONNECTOR 205 is extracted, ACTUATOR PLATE 209 can be returned to the OPEN position, releasing ENGAGEMENT PINS 207 from ENGAGEMENT HOLES 208 thereby freeing CABLE CONNECTOR 205 from EXTRACTION TOOL 204. See FIG. 1. Note: The present invention also may be used to insert the cable connector.

Figure 6:
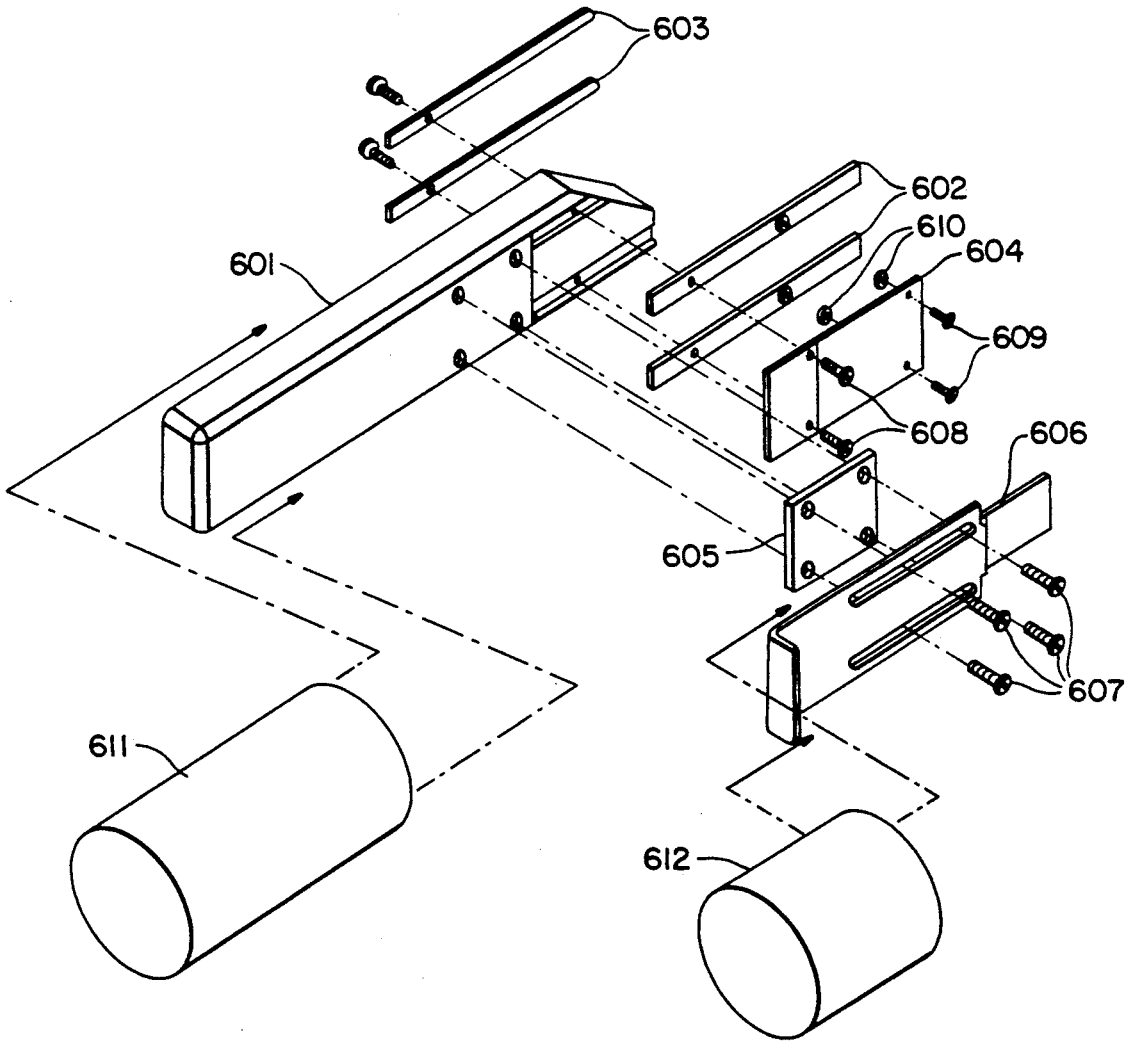
FIG. 6 in an exploded view of the present invention.

Referring next to FIG. 6, the EXTRACTION TOOL will be described in greater detail. The bulk of the tool is comprised of HANDLE 601. HANDLE 601 can be made from any rigid material such as aluminum. Attached to HANDLE 601 are LEFT GUIDES 603 and RIGHT GUIDES 602. These four guides make-up ALIGNMENT MEMBERS 206 of FIG. 2. LOCKING PLATE 604 and RIGHT GUIDES 602 are firmly attached to the right side of HANDLE 601 by SCREWS 608. SCREWS 609 slid through LOCKING PLATE 604 and are held in place by NUTS 610. SCREWS 609 extend beyond NUTS 610 and align with the holes in RIGHT GUIDES 602. SCREWS 609 form ENGAGEMENT PINS 207 of FIG. 2. ACTUATOR PLATE 606 is attached so that linear motion along the handle is possible. SCREWS 607 provide a sliding rail for ACTUATOR PLATE 606, while SPACER 605 places the ACTUATOR PLATE 606 at the proper height. Because SCREWS 607 are not tightened down onto ACTUATOR PLATE 606, another means for securing them into HANDLE 601 must be used. The use of some kind of glue, such as Locktite, is the most common method. Finally, HEATSRINK TUBING 611 and 612 are applied over their respective parts to provide some comfort and safety to the use of the tool.

Figure 7A:
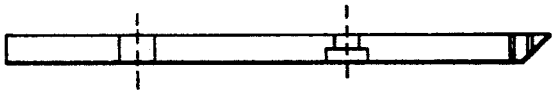
FIGS. 7A–7C show the GUIDES in greater detail.
Figure 7B:
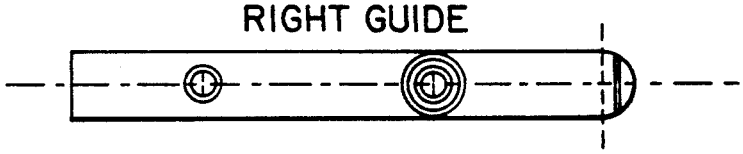
Figure 7C:
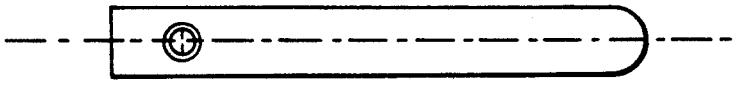

The RIGHT and LEFT GUIDES are shown in greater detail in FIG. 7. The GUIDES are made of a rigid material, such as tool steel, aluminum being too soft for this application. LEFT and RIGHT GUIDES are essentially the same, however, there are several small differences. First, the mounting holes (those farthest from the rounded end) are in different places. This is to off-set the mounting screws when attached to the HANDLE. The second difference is that the RIGHT GUIDE has an additional hole. This hole, which is counter sunk, allows for SCREWS 609 of FIG. 6 to pass through and enter ENGAGEMENT HOLES 208 of CABLE CONNECTOR 205, both of FIG. 2. Finally, the RIGHT GUIDE's curved end is beveled to aid proper insertion into CABLE SHROUD 202 of FIG. 2.

Figure 8C:
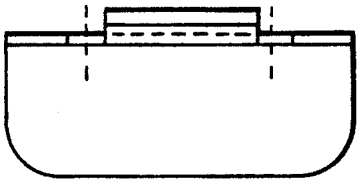
FIGS. 8A–8C show the ACTUATOR PLATE in greater detail.
Figure 8A:
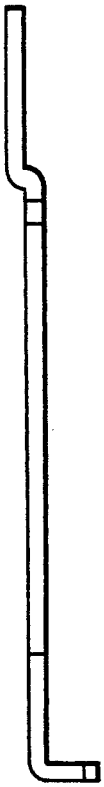
Figure 8B:
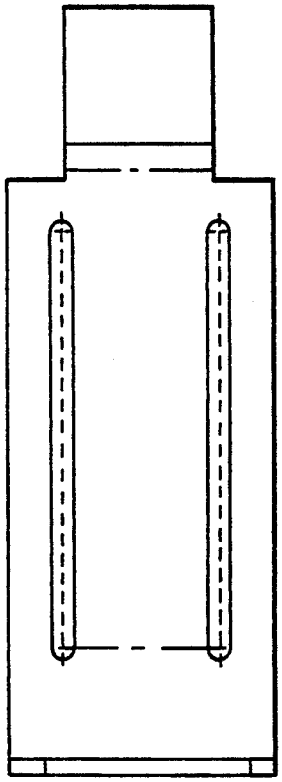

Referring next to FIG. 8, ACTUATOR PLATE is shown in greater detail. ACTUATOR PLATE is made from a rigid material, such as CR steel, aluminum being too soft for this application.

Next, the basic steps for proper use of the present invention will be given:

STEP 1 (FIG. 2): Align the tool to the CABLE CONNECTOR with the ACTUATOR PLATE in the open position.

STEP 2 (FIG. 3): Insert the tool over the CABLE CONNECTOR making sure that the front of the tool handle makes full contact with the read of the connector housing. This will ensure alignment of the ENGAGEMENT PINS with the ENGAGEMENT HOLES on the CABLE CONNECTOR. The ALIGNMENT MEMBERS separate the SHROUD LOCKING TABS from the CABLE CONNECTOR.

STEP 3 (FIG. 4): Press the ACTUATOR PLATE forward to mate the ENGAGEMENT PINS with the CABLE CONNECTOR.

STEP 4 (FIG. 5): Apply unidirectional force (pull) to extract the CABLE CONNECTOR from the CABLE SHROUD.

STEP 5 (FIG. 1): Release the CABLE CONNECTOR from the TOOL by returning the ACTUATOR PLATE to the open position.

Note: Insertion can be accomplished by reversing the order of the above steps.

Although the preferred embodiment of the invention has been illustrated, and that form described, it is readily apparent to those skilled in the art that various modifications may be made therein without departing from the spirit of the invention or from the scope of the appended claims.

What is claimed is:

1. A tool for extracting a cable connector from a cable shroud, said cable connector having engagement holes, said tool comprising:

a handle having a first side and a second side;

a first set of guides having an end firmly attached to said first side of said handle;

a second set of guides having an end firmly attached to said second side of said handle, said second set of guides having a set of holes extending laterally through said second set of guides, said set of holes align with said engagement holes;

a locking plate having an end firmly attached to said second side of said handle, said end of said second set of guides and said end of said locking plate being commonly attached to said side of said handle, said locking plate extending over said second set of guides, said locking plate having a set of engagement pins aligned to mate with said set of holes in said second set of guides; and an actuator plate attached to said second side of said handle, whereby moving said actuator plate longitudinally along said second side of said handle moves said locking plate laterally forcing said engagement pins through said set of holes in said second set of guides and into said engagement holes in said cable connector thereby providing a mechanical connection between said tool and said cable connector, said mechanical connection allowing for proper extraction of said cable connector from said cable shroud.

2. A tool for extracting a cable connector from a cable shroud as claimed in claim 1 further comprising:

a first protective coating over said handle, and a second protective coating over said actuator plate.

3. A tool or extracting a cable connector from a cable shroud as claimed in claim 1 wherein:

said cable shroud having locking tabs, and when said tool is properly placed over said cable connector, said first set of guides and said second set of guides unlock said locking tabs of said cable shroud.

4. A tool for extracting a cable connector from a cable shroud as claimed in claim 1 wherein said handle has a rectangle cross sectional shape.

5. A tool for extracting a cable connector from a cable shroud, said cable connector having engagement holes, said tool comprising:

a handle having a side;

a set of guides having an end firmly attached to said handle, said set of guides having a set of holes extending laterally through said set of guides, said set of holes align with said engagement holes;

a locking plate having an end firmly attached to said side of said handle, said locking plate having a set of engagement pins aligned to mate with said set of holes in said set of guides; and an actuator plate attached to said side of said handle, whereby moving said actuator plate longitudinally along said side of said handle moves said locking plate laterally forcing said engagement pins through said set of holes in said set of guides and into said engagement holes in said cable connector thereby providing a mechanical connection between said tool and said cable connector, said mechanical connection allowing for proper extraction of said cable connector from said cable shroud.

6. A tool for extracting a cable connector from a cable shroud as claimed in claim 5 further comprising:

a first protective coating over said handle, and a second protective coating over said actuator plate.

7. A tool for extracting a cable connector from a cable shroud as claimed in claim 5 wherein:

said cable shroud having locking tabs, and said first set of guides and said second set of guides unlock said locking tabs of said cable shroud.

8. A tool for extracting a cable connector from a cable shroud as claimed in claim 5 wherein said handle having a rectangle cross sectional shape.

9. A tool for extracting a cable connector from a cable shroud, said cable connector having engagement holes, said cable shroud having locking tabs, said tool comprising:

a handle having a first side and a second side;

a first set of guides having an end firmly attached to said first side of said handle;

a second set of guides having an end firmly attached to said second side of said handle, when said tool is properly placed over said cable connector, said first set of guides and said second set of guides unlock said locking tabs of said cable shroud, said second set of guides having a set of holes extending laterally through said second set of guides, said set of holes align with said engagement holes;

a locking plate having an end firmly attached to said second side of said handle, said end of said second set of guides and said end of said locking plate being commonly attached to said side of said handle, said locking plate extending over said second set of guides, said locking plate having a set of engagement pins aligned to mate with said set of holes in said second set of guides; and an actuator plate attached to said second side of said handle, whereby moving said actuator plate longitudinally along said second side of said handle moves said locking plate laterally forcing said engagement pins through said set of holes in said second set of guides and into said engagement holes in said cable connector thereby providing a mechanical connection between said tool and said cable connector, said mechanical connection allowing for proper extraction of said cable connector from said cable shroud.

10. A tool for extracting a cable connector from a cable shroud as claimed in claim 9 further comprising:

a first protective coating over said handle, and a second protective coating over said actuator plate.

11. A tool for extracting a cable connector from a cable shroud as claimed in claim 9 wherein said handle has a rectangle cross sectional shape.

* * * * *